United States Patent [19]

Kobayashi et al.

[11] Patent Number: 4,644,921

[45] Date of Patent: Feb. 24, 1987

[54] METHOD AND APPARATUS FOR CONTROLLING AIR-FUEL RATIO IN INTERNAL COMBUSTION ENGINE

[75] Inventors: Nobuyuki Kobayashi; Toshimitsu Ito, both of Toyota, Japan

[73] Assignee: Toyota Jidosha Kabushiki Kaisha, Toyota, Japan

[21] Appl. No.: 727,262

[22] Filed: Apr. 25, 1985

[30] Foreign Application Priority Data

Apr. 28, 1984 [JP] Japan ..... 59-85105

[51] Int. Cl.[4] ..... F02D 41/14

[52] U.S. Cl. ..... 123/489; 123/491

[58] Field of Search ..... 123/489, 440, 589, 491

[56] References Cited

U.S. PATENT DOCUMENTS 4,109,615 8/1978 Asano ..... 123/440
4,169,440 10/1979 Taplin et al. ..... 123/489
4,175,521 11/1979 Hattori et al. ..... 123/589
4,348,996 9/1982 Morozumi ..... 123/440
4,561,403 12/1985 Oyama et al. ..... 123/489

FOREIGN PATENT DOCUMENTS 58-172443 10/1983 Japan ..... 123/489

OTHER PUBLICATIONS

Patents Abstracts of Japan, vol. 6, No. 246 (M-176) [1124], 4th Dec. 1982, JP-A, abstract of No. 57 143143 (Toyota Jidosha Kogyo K.K.) 04-09-1982.

*Primary Examiner*—Andrew M. Dolinar
*Attorney, Agent, or Firm*—Cushman, Darby & Cushman

[57] ABSTRACT

In an internal combustion engine, feedback control of the air-fuel ratio is carried out in accordance with the concentration of a specific composition in the exhaust gas, so that the air-fuel ratio is close to a target air-fuel ratio on the lean side with respect to the stoichimetric air-fuel ratio, the target air-fuel ratio is variable in accordance with the engine temperature.

8 Claims, 18 Drawing Figures

| |
|---|
| Fig. 6A |
| Fig. 6 B |

| Fig. 9A |
| --- |
| Fig. 9B |

METHOD AND APPARATUS FOR CONTROLLING AIR-FUEL RATIO IN INTERNAL COMBUSTION ENGINE

BACKGROUND OF THE INVENTION (1) Field of the Invention

The present invention relates to a method and apparatus for feedback control of the air-fuel ratio in an internal combustion engine.

(2) Description of the Related Art

As a measure taken against exhaust gas pollution and fuel consumption, a lean burn system has recently been developed. According to this lean burn system, a lean mixture sensor is provided for generating an analog current in proportion to the lean air-fuel mixture in an exhaust pipe of an engine. Thus, feedback control of the air-fuel ratio of the engine can be accomplished by using the analog output of the lean mixture sensor, thereby attaining an arbitrary air-fuel ratio on the lean side.

In such a lean burn system, when the engine is in a warming-up mode, feedback control of the air-fuel ratio for the stoichimetric air-fuel ratio has also been carried out and the exhaust gas cleaned by a three-way catalytic converter. This, naturally, reduces the fuel consumption efficiency during the warming-up mode.

In order to improve the fuel consumption efficiency during the warming-up mode, a lean burn system can be forcibly applied to a warming-up mode engine in the same way as to the after-warming-up mode engine. In this case, however, when the temperature of the engine is too low, vaporization of fuel within chambers of the engine is poor, so that the combustion of fuel is insufficient, inviting misfires and thus reducing drivability.

SUMMARY OF THE INVENTION

It is an object of the present invention to provide a method and apparatus for controlling the air-fuel ratio in an internal combustion engine in which the feedback control of the air-fuel ratio on the lean side is possible without inviting misfiring of the engine even when the engine is in a warming-up mode, thereby improving the drivability.

According to the present invention, in an internal combustion engine wherein feedback control of the air-fuel ratio is carried out in accordance with the concentration of a specific composition, such as oxygen, in the exhaust gas, so that the air-fuel ratio is close to a target air-fuel ratio on the lean side with respect to the stoichimetric air-fuel ratio, the target air-fuel ratio is variable in accordance with the engine temperature. As a result, when the engine is in a warming-up mode, i.e., when the temperature of the engine is low, the target air-fuel ratio can be on the lean side with respect to the stoichimetric air-fuel ratio. In this case, when the temperature of the engine is too low, the target air-fuel ratio can be rich, however, actually on the lean side with respect to the stoichimetric air-fuel ratio.

BRIEF DESCRIPTION OF THE DRAWINGS

The present invention will be more clearly understood from the description as set forth below with reference to the accompanying drawings, wherein:

FIGS. 3, 3A, 3B, 6, 6A, 6B, 9, 9A, 9B, 10, 11 and 12 are flow charts showing the operation of the control circuit of FIG. 1;

DESCRIPTION OF THE PREFERRED EMBODIMENTS

Figure 1:
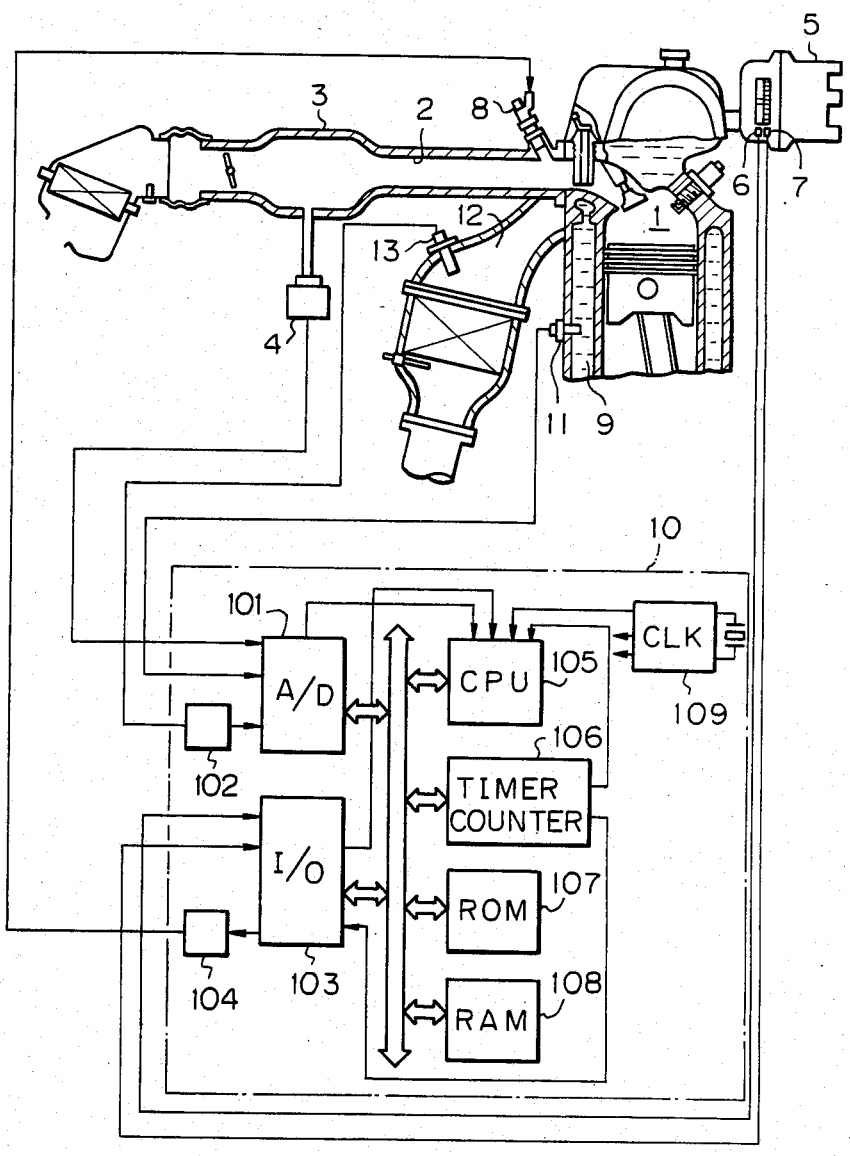
FIG. 1 is a schematic diagram of an internal combustion engine according to the present invention.

In FIG. 1, which illustrates an internal combustion engine according to the present invention, reference numeral 1 designates a four-cycle spark ignition engine disposed in an automotive vehicle. Provided in an air-intake passage 2 of the engine 1 is a surge tank 3 in which a pressure sensor 4 is provided. The pressure sensor 4 is used for detecting the absolute pressure within the intake-air passage 2 and transmits its output signal to a multiplexer-incorporating analog-to-digital (A/D) converter 101 of a control circuit 10.

Disposed in a distributor 5 are crank angle sensors 6 and 7 for detecting the angle of the crankshaft (not shown) of the engine 1. In this case, the crank-angle sensor 6 generates a pulse signal at every 720° crank angle (CA) while the crank-angle sensor 7 generates a pulse signal at every 30° CA. The pulse signals of the crank angle sensors 6 and 7 are supplied to an input/output (I/O) interface 103 of the control circuit 10. In addition, the pulse signal of the crank angle sensor 7 is then supplied to an interruption terminal of a central processing unit (CPU) 105.

Additionally provided in the air-intake passage 2 is a fuel injector 8 for supplying pressurized fuel from the fuel system (not shown) to the air-intake port of the cylinder of the engine 1. In this case, other fuel injectors are also provided for other cylinders, though not shown in FIG. 1.

Disposed in a cylinder block 9 of the engine 1 is a coolant temperature sensor 11 for detecting the temperature of the coolant. The coolant temperature sensor 11 generates an analog voltage signal in response to the temperature of the coolant and transmits it to the A/D converter 101 of the control circuit 10.

Figure 2:
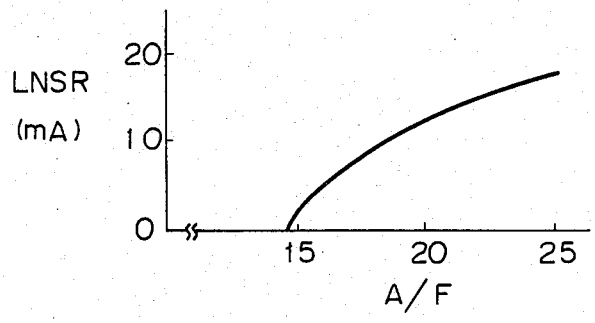
FIG. 2 is a graph showing the output characteristics of the lean mixture sensor of FIG. 1.

Provided in an exhaust gas passage 12 of the engine 1 is a lean mixture sensor 13 for detecting the concentration of oxygen composition in the exhaust gas. The lean mixture sensor 13 generates a current signal LNSR as shown in FIG. 2 and transmits it via a current-to-voltage converter circuit 102 of the control circuit 10 to the A/D converter 101 thereof.

The control circuit 10, which may be comprised of a microcomputer, includes a driver circuit 104 for driving the fuel injector 8, a timer counter 106, a read-only memory (ROM) 107 for storing a main routine, interrupt routines such as a fuel injection routine, an ignition timing routine, tables (maps), constants, etc., a random access memory 108 (RAM) for storing temporary data, a clock generator 109 for generating various clock signals, and the like, in addition to the A/D converter 101, the current-to-voltage converter circuit 102, the I/O interface 103, and the CPU 105.

The timer counter 106 may include a free-run counter, a compare register, a comparator for comparing the content of the free-run counter with that of the compare register, flag registers for compare interruption, injection control, and the like. Of course, the timer counter 106 also may include a plurality of compare registers and a plurality of comparators. In this case, the timer counter 106 is used for controlling the injection start and end operation.

Interruptions occur at the CPU 105, when the A/D converter 101 completes an A/D conversion and generates an interrupt signal; when the crank angle sensor 7 generates a pulse signal; when the timer counter 106 generates a compare interrupt signal; and when the clock generator 109 generates a special clock signal.

The pressure data PM of the pressure sensor 4, the coolant temperature data THW, and the current data LNSR of the lean mixture sensor 13 are fetched by an A/D conversion routine(s) executed at every predetermined time period and are then stored in the RAM 108. That is, the data PM, THW, and LNSR in the RAM 108 are renewed at every predetermined time period. The engine rotational speed Ne is calculated by an interrupt routine executed at 30° CA, i.e., at every pulse signal of the crank angle sensor 7, and is then stored in the RAM 108.

The operation of the control circuit 10 of FIG. 1 will be explained with reference to the flow charts of FIGS. 3, 6, and 9 through 12.

Figure 3A:
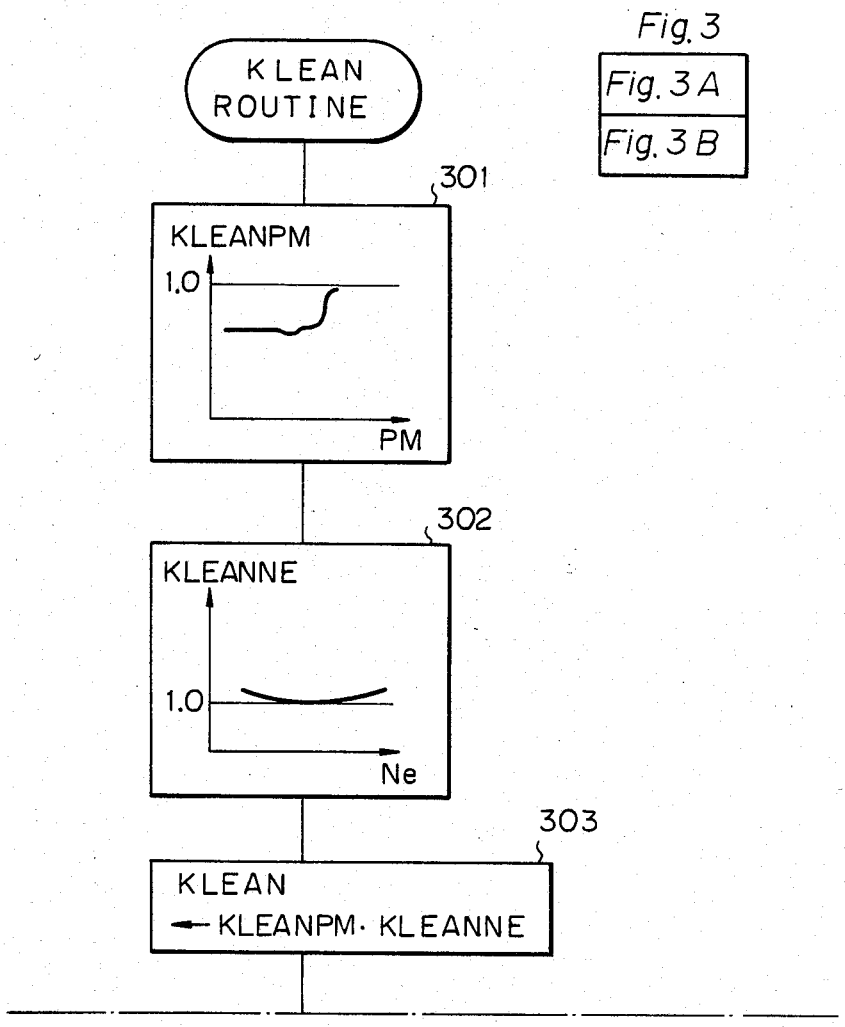
Figure 3B:
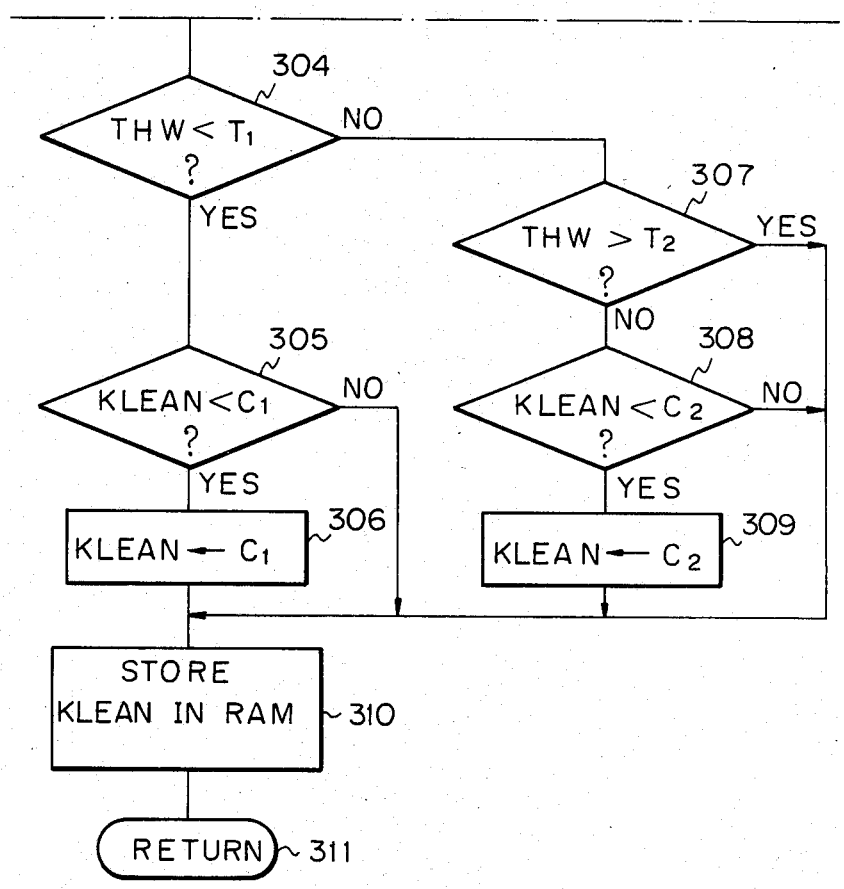

FIG. 3 is a routine for calculating a lean air-fuel ratio correction coefficient KLEAN executed at every predetermined time period. Note that the coefficient KLEAN satisfies the condition: $KLEAN \leqq 1.0$.

At step 301, KLEANPM is calculated from a one-dimensional map stored in the ROM 107 by using the parameter PM as shown in the block of step 301. Also, at step 302, KLEANNE is calculated from a one-dimensional map stored in the ROM 107 by using the parameter Ne as shown on the block of step 302. Then at step 303, $$KLEAN \leftarrow KLEANPM \cdot KLEANNE.$$

At step 304, it is determined whether or not the coolant temperature THW stored in the RAM 108 is lower than a predetermined temperature $T_1$, which is, for example, 55° C., while at step 307, it is determined whether or not the coolant temperature THW is higher than a predetermined temperature $T_2$, which is, for example, 80° C. That is, the temperature $T_2$ is higher than the temperature $T_1$. Note that a warming-up operation is usually completed, when the coolant temperature THW reaches the temperature $T_2$.

When $THW < T_1$, then the proceeds to steps 305 and 306 in which the lean air-fuel ratio correction coefficient KLEAN is guarded by a lower limit value $C_1$ which is relatively large and is, for example, 1.0. That is, at step 305, it is determined whether or not the coefficient KLEAN is smaller then the lower limit value $C_1$. If $KLEAN < C_1$, then at step 306, $KLEAN \leftarrow C_1$. Otherwise, the control proceeds directly to step 310.

When $T_1 \leqq THW \leqq T_2$, then the control proceeds to steps 308 and 309 in which the lean air-fuel ratio correction coefficient KLEAN is guarded by a lower limit value $C_2$. The lower limit value $C_2$ is smaller than the lower limit value $C_1$, and is, for example, 0.6 to 0.8. That is, at step 308, it is determined whether or not the coefficient KLEAN is smaller than the lower limit value $C_2$. If $KLEAN < C_2$, then at step 309, $KLEAN \leftarrow C_2$. Otherwise, the control proceeds directly to step 310.

When $THW > T_2$, then the control proceeds directly to step 310. That is, in this case, since it is considered that a warming-up operation is completed, no limitation is applied to the lean air-fuel correction coefficient KLEAN.

Thus, the finally obtained lean air-fuel ratio correction coefficient KLEAN is stored in the RAM 108 at step 310. The routine of FIG. 3 is completed by step 311.

Figure 4:
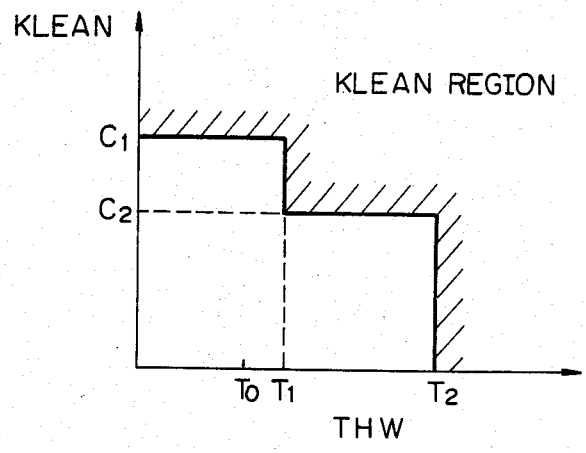
FIGS. 4 and 5 are graphs for explaining the flow chart of FIG. 3.

The lean air-fuel ratio correction coefficient KLEAN calculated by the routine of FIG. 3 will be explained with reference to FIG. 4. As shown in FIG. 4, if $THW < T_1$, the coefficient KLEAN is controlled to be larger than the limit value $C_1$. If $T_1 \leqq THW \leqq T_2$, the coefficient KLEAN is controlled to be larger than the limit value $C_2$. If $THW > T_2$, no limitation is applied to the coefficient KLEAN derived by the parameters PM and Ne. Thus, the lower limit value of the lean air-fuel ratio correction coefficient KLEAN is controlled by the coolant temperature THW. Particularly, when the coolant temperature THW is low so that the vaporization of fuel is insufficient, the coefficient KLEAN is guarded by a large lower limit value, i.e., the value $C_1$. As will be explained later, the controlled air-fuel ratio is determined by the coefficient KLEAN. Therefore, the air-fuel ratio is controlled in accordance with the coolant temperature THW. As a result, when the coolant temperature THW is low, the controlled lean air-fuel ratio becomes richer.

Note that a value $T_0$ of the coolant temperature THW is, for example, 50° C. In this case, the condition $THW \geqq T_0$ is one of the feedback control conditions, which will be later explained. That is, if $THW \geqq T_0$ and the other feedback control conditions are satisfied, feedback control (closed-loop control) of the air-fuel ratio is carried out, while, if $THW < T_0$, open-loop control of the air-fuel ratio is carried out.

Figure 5:
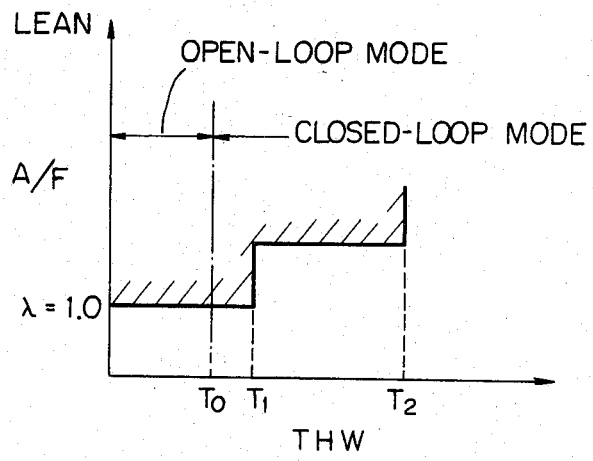

FIG. 5 shows the lower limit characteristics of the controlled air-fuel ratio in the case where control of the air-fuel ratio is carried out by using the lean air-fuel ratio correction coefficient KLEAN obtained by the routine of FIG. 3. As shown in FIG. 5, the lower limit of the controlled air-fuel ratio is dependent upon the coolant temperature THW. That is, even during a warming-up mode ($T_1 \leqq THW \leqq T_2$), fuel combustion is carried out at a lean air-fuel ratio. Further, during a warming-up mode where the coolant temperature THW is too low ($T_0 \leqq THW < T_1$), fuel combustion may be carried out at a lean air-fuel ratio. Thus, the fuel consumption efficiency during a warming-up mode is improved without reducing the combustion state.

Figures 6, 6A:
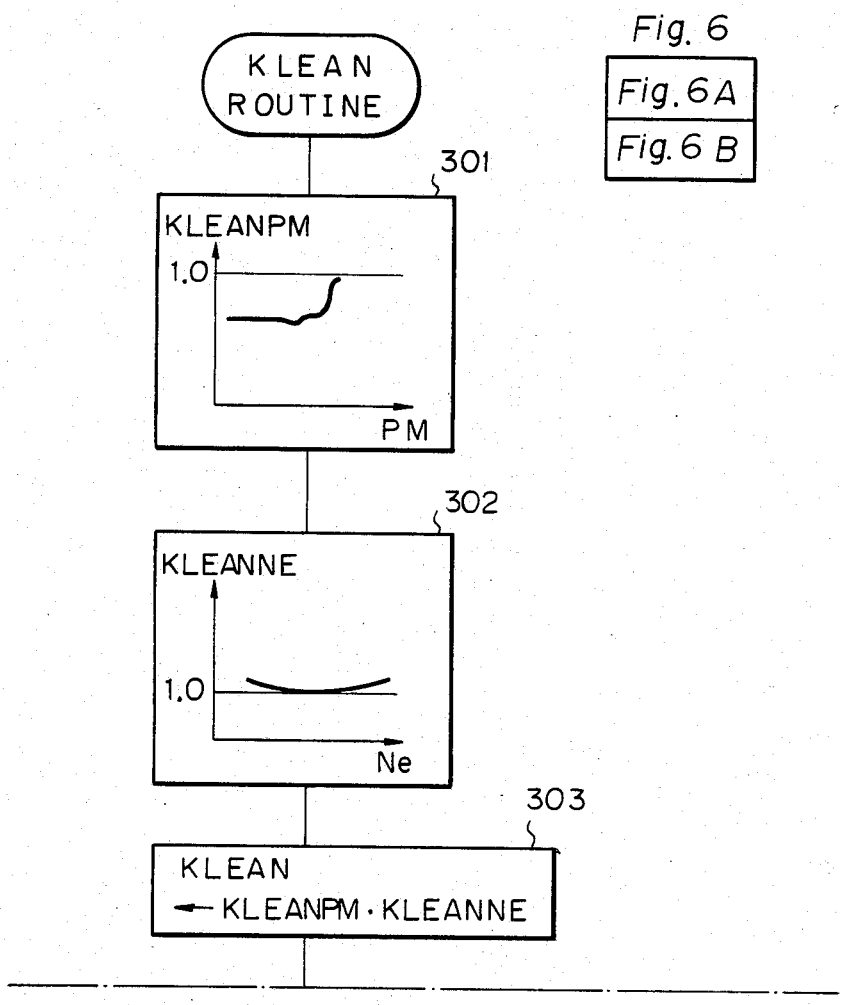
Figure 6B:
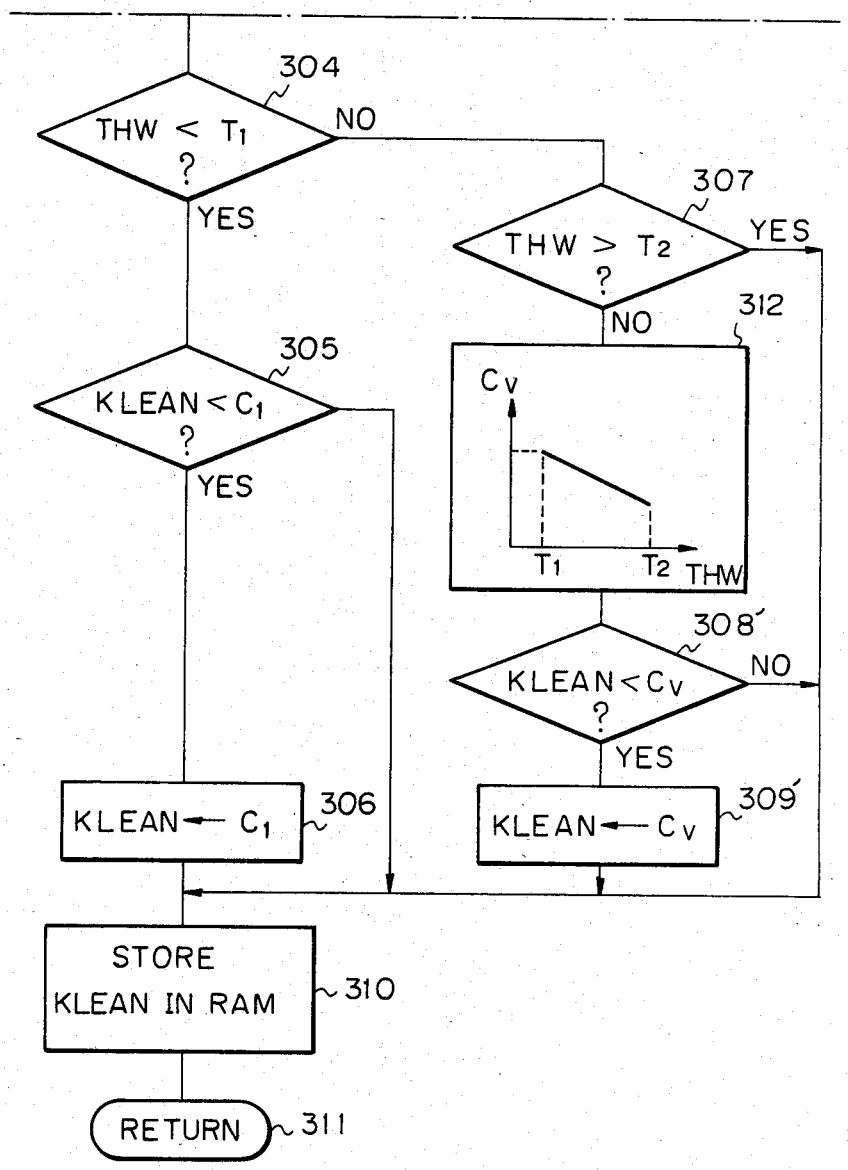

In FIG. 6, which is a modification of the routine of FIG. 3, step 312 is added to the routine of FIG. 3, and steps 308' and 309' are provided instead of steps 308 and 309 of FIG. 3. In this routine of FIG. 6, when $T_1 \leqq THW \leqq T_2$, the flow of steps 312, 308' and 309' is carried out. That is, at step 312, a lower limit value $C_\nu$ is calculated from a one-dimensional map stored in the ROM 107 by using the parameter THW as shown in the block of step 312. At steps 308' and 309', the lean air-fuel ratio correction coefficient KLEAN is guarded by the lower limit value $C_\nu$. That is, at step 308', it is determined whether or not the coefficient KLEAN is smaller than the lower limit value $C_\nu$. If $KLEAN < C_\nu$, then at step 309', $KLEAN \eta C_\nu$. Otherwise, the control proceeds directly to step 310. Thus, if $T_1 \leqq THW \leqq T_2$, the lower limit value of the coefficient KLEAN is variable.

Figure 7:
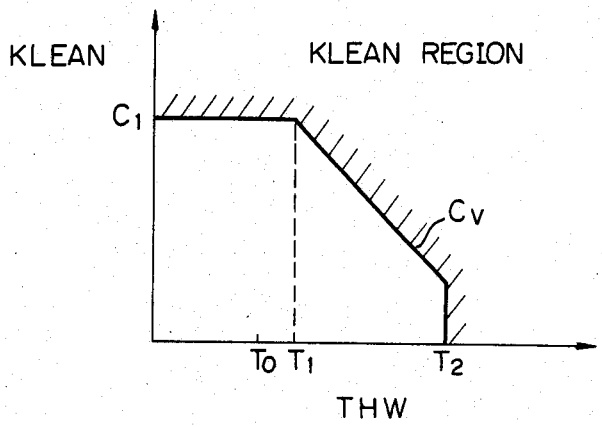
FIGS. 7 and 8 are graphs for explaining the flow chart of FIG. 6.
Figure 8:
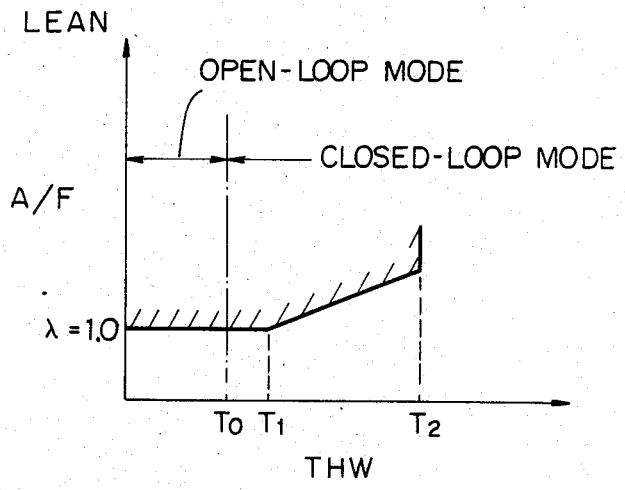

FIG. 7 shows the lean air-fuel ratio correction coefficient KLEAN calculated by the routine of FIG. 6, and FIG. 8 shows the lower limit characteristics of the controlled air-fuel ratio in the case where control of the air-fuel ratio is carried out by using the lean air-fuel ratio correction coefficient KLEAN obtained by the routine of FIG. 6. As shown in FIGS. 7 and 8, within the range of $T_1 \leqq THW \leqq T_2$, the lower limit value of the coefficient is variable in accordance with the coolant temperature THW, carrying out fine air-fuel ratio control thereby obtaining further excellent improvement of the fuel consumption efficiency.

Figures 9, 9A:
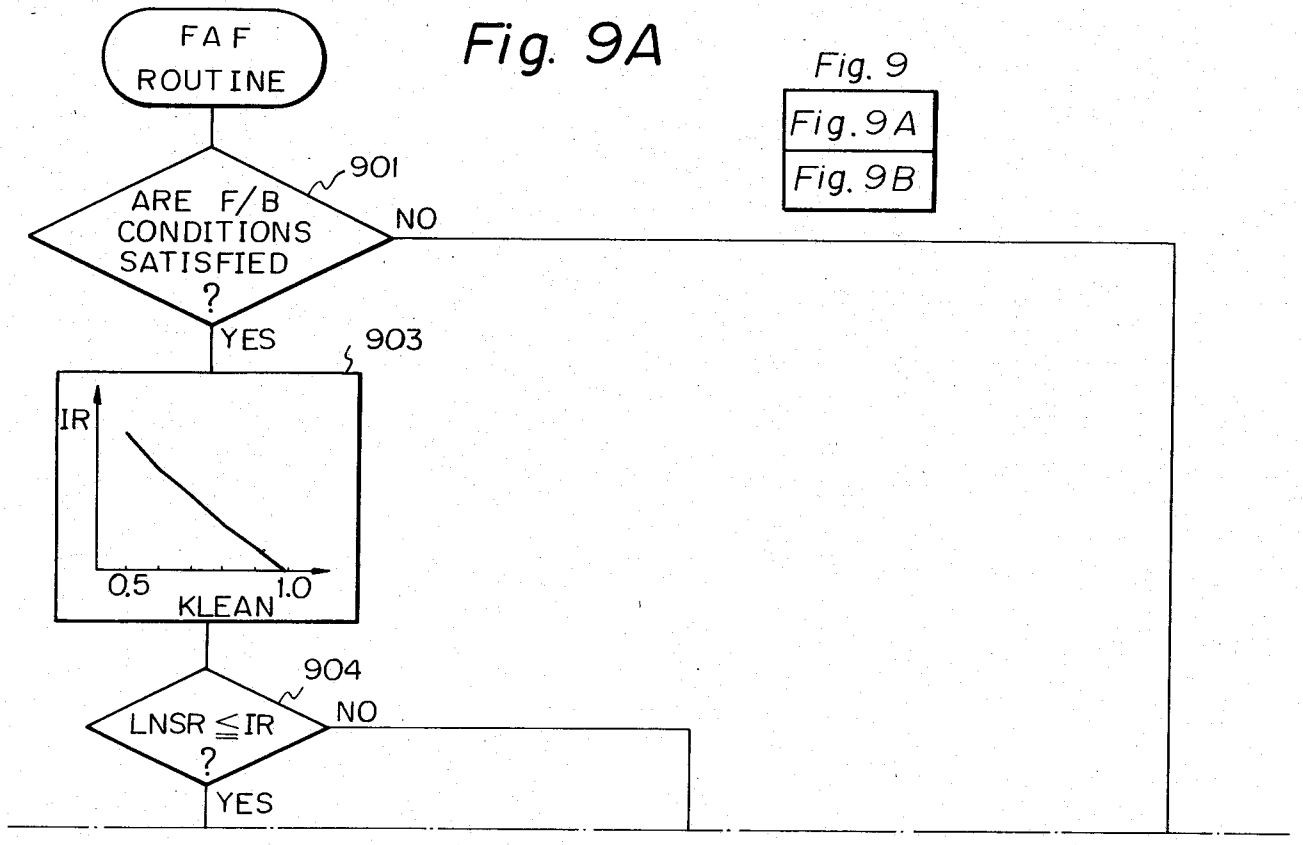
Figure 9B:
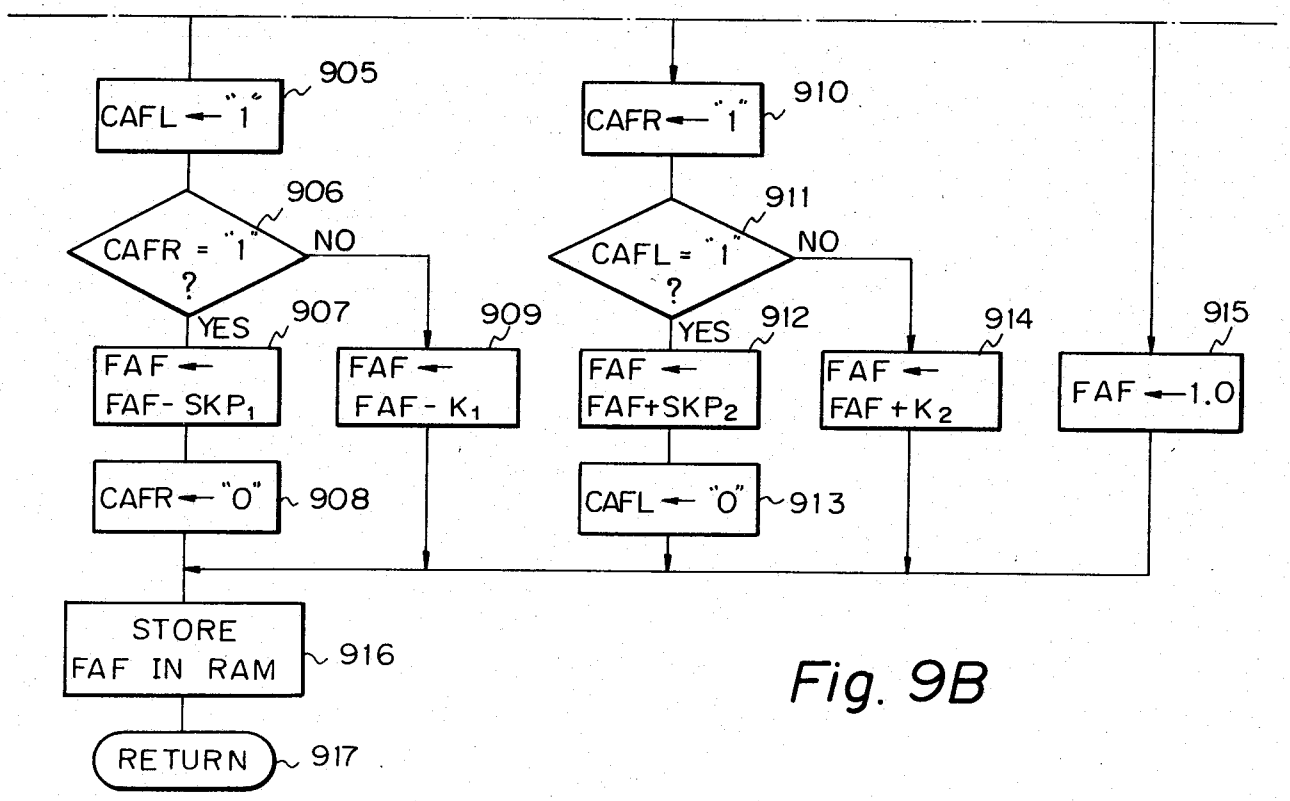

FIG. 9 is a routine for calculating an air-fuel ratio feedback correction coefficient FAF executed at every predetermined time period.

At step 901, it is determined whether or not all the feedback control (closed-loop control) conditions are satisfied. The feedback control conditions are as follows:

(i) the engine is not in a starting state;

(ii) the incremental fuel injection is not being carried out; and (iii) the coolant temperature THW is higher than the temperature $T_0$ (see FIGS. 4, 5, 7, and 8).

Of course, other feedback control conditions are introduced as occasion demands. However, an explanation of such other feedback control conditions is omitted.

If at least one of the feedback control conditions is not satisfied, the control proceeds to step 915 in which the coefficient FAF is caused to be 1.0 (FAF=1.0), thereby carrying out an open-loop control operation. Contrary to this, if all the feedback control conditions are satisfied, the control proceeds to step 903.

At step 903, a comparison reference value IR is calculated from a one-dimensional map stored in the ROM 107 by using the parameter KLEAN obtained by the routine of FIG. 3 or 6. Note that this one-dimensional map is shown in the block of step 903. That is, the comparison reference value IR is variable in accordance with the coefficient KLEAN, thereby changing the target air-fuel ratio of the feedback control in accordance with the coefficient KLEAN.

At step 904, the output LNSR of the lean mixture sensor 13 stored in the RAM 108 is compared with the comparison reference value IR, thereby determining whether the current air-fuel ratio is on the rich side or on the lean side with respect to the target air-fuel ratio. If LNSR≦IR so that the current air-fuel ratio is on the rich side, the control proceeds to step 905 in which a lean skip flag CAFL is set, i.e., CAFL←"1". Note that the lean skip flag CAFL is used for a skip operation when a first change from the rich side to the lean side occurs in the controlled air-fuel ratio.

At step 906, it is determined whether or not a rich skip flag CAFR is "1". Note that the skip flag CAFR is used for a skip operation when a first change from the lean side to the rich side occurs in the controlled air-fuel ratio. As a result, if the rich skip flag CAFR is "1", the control proceeds to step 907, which decreases the coefficient FAF by a relatively large amount $SKP_1$. Then, at step 908, the rich skip flag CAFR is cleared, i.e., CAFR←"0". Thus, when the control at step 906 is further carried out, then the control proceeds to step 909, which decreases the coefficient FAF by a relatively small amount $K_1$. Here, $SKP_1$ is a constant for a skip operation which remarkably decreases the coefficient FAF when a first change from the lean side (LNSR>IR) to the rich side (LNSR≦IR) occurs in the controlled air-fuel ratio, while $K_1$ is a constant for an integration operation which gradually decreases the coefficient FAF when the controlled air-fuel ratio is on the rich side.

On the other hand, at step 904, if LNSR>IR so that the current air-fuel ratio is on the lean side, the control proceeds to step 910 in which the rich skip flag CAFR is set, i.e., CAFR←"1". Then, at step 911, it is determined whether or not the lean skip flag CAFL is "1". As a result, if the lean skip flag CAFL is "1", the control proceeds to step 912, which increases the coefficient FAF by a relatively large amount $SKP_2$. Then, at step 913, the lean skip flag CAFL is cleared, i.e., CAFL←"0". Thus, when the control at step 911 is further carried out, then the control proceeds to step 914, which increases the coefficient FAF by a relatively small amount $K_2$. Here, $SKP_2$ is a constant for a skip operation which remarkably increases the coefficient FAF when a first change from the rich side (LNSR≦IR) to the lean side (LNSR>IR) occurs in the controlled air-fuel ratio, while $K_2$ is a constant for an integration operation which gradually increases the coefficient FAF when the controlled air-fuel ratio is on the lean side.

The air-fuel feedback correction coefficient FAF obtained at steps 907, 909, 912, 914, or 915 is stored in the RAM 108, and the routine of FIG. 9 is completed by step 917.

Figure 10:
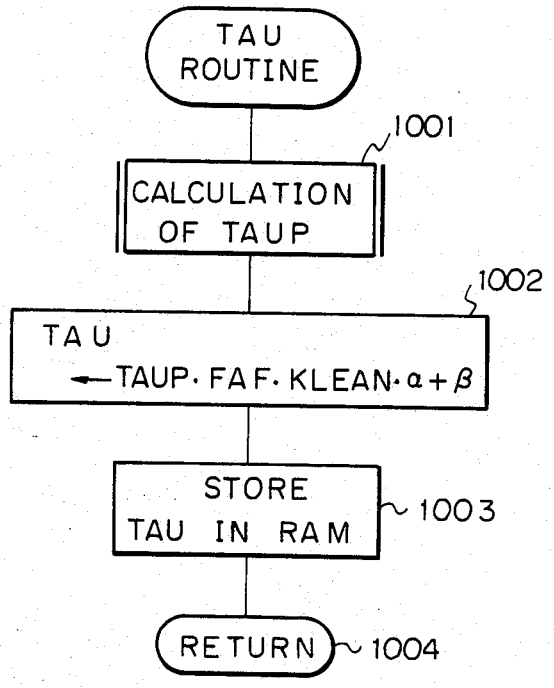

FIG. 10 is a routine for calculating a fuel injection time period TAU executed at every predetermined crank angle. For example, this routine is executed at every 360° CA in a simultaneous fuel injection system for simultaneously injecting all the injectors and is executed at every 180° CA in a sequential fuel injection system applied to a four-cylinder engine for sequentially injecting the injectors thereof.

At step 1001, a base fuel injection time period TAUP is calculated from a two-dimensional map stored in the ROM 107 by using the parameters PM and Ne. Then, at step 1002, a fuel injection time period TAU is calculated by $$TAU \leftarrow TAUP \cdot FAF \cdot KLEAN \cdot \alpha + \beta$$

where $\alpha$ and $\beta$ are correction factors determined by other parameters such as the signal of the intake air temperature sensor, the voltage of the battery (both not shown), and the like. At step 1003, the calculated fuel injection time period TAU is stored on the RAM 108, and the routine of FIG. 10 is completed by step 1004.

Figure 11:
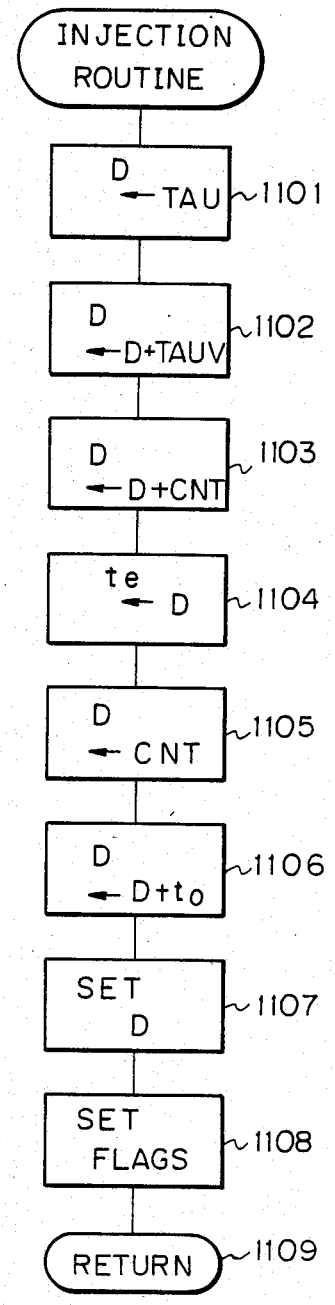

FIG. 11 is a routine for controlling the fuel injection in accordance with the fuel injection time period TAU calculated by the routine of FIG. 10, executed at every predetermined crank angle. Also, this routine is executed at every 360° CA in a simultaneous fuel injection system and is executed at every 180° CA in a sequential fuel injection system applied to a four-cylinder engine.

At step 1101, the fuel injection time period TAU stored in the RAM 108 is read out and is transmitted to the D register (not shown) included in the CPU 105. At step 1102, an invalid fuel injection time period TAUV which is also stored in the RAM 108 is added to the content of the D register. In addition, at step 1103, the current time CNT of the free-run counter of the timer counter 106 is read out and is added to the content of the D register, thereby obtaining an injection end time $t_e$ in the D register. Therefore, at step 1104, the content of the D register is stored as the injection end time $t_e$ in the RAM 108.

Again at step 1105, the current time CNT of the free-run counter is read out and is set in the D register. Then, at step 1106, a small time period $t_0$, which is definite or determined by predetermined parameters, is added to the content of the D register. At step 1107, the content of the D register is set in the compare register of the timer counter 106, and at step 1108, a fuel injection execution flag and a compare interrupt permission flag are set in the registers of the timer counter 106. Then, the routine of FIG. 11 is completed by step 1109.

Figure 12:
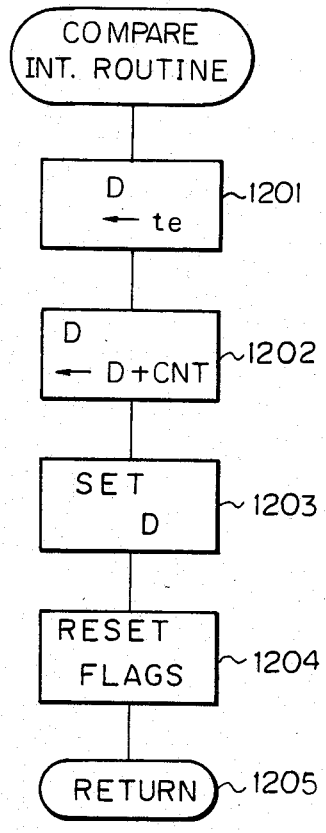

Thus, when the current time CNT of the free-run counter reaches the compare register, an injection-on signal due to the presence of the fuel injection execution flag is transmitted from the time counter 106 via the I/O interface 103 to the driver circuit 104, thereby initiating a fuel injection by the fuel injector 8. Simultaneously, a compare interrupt signal due to the presence of the compare interrupt permission flag is transmitted from the timer counter 106 to the CPU 105, thereby initiating a compare interrupt routine as illustrated in FIG. 12.

The completion of the fuel injection will be explained with reference to FIG. 12. At step 1201, the injection end time $t_e$ stored in the RAM 108 is read out and is transmitted to the D register. Then, at step 1202, the content of the D register (i.e., the injection end time $t_e$), is set in the compare register of the timer counter 106, and at step 1203, the fuel injection execution flag and the compare interrupt permission flag are reset. Then, the routine of FIG. 12 is completed by step 1204.

Thus, when the current time CNT of the free-run counter reaches the compare register, an injection-off signal due to the absence of the fuel injection execution flag is transmitted from the timer counter 106 via the I/O interface 103 to the driver circuit 104, thereby ending the fuel injection by the fuel injector 8. In this case, however, no compare interrupt signal is generated due to the absence of the compare interrupt permission flag.

Thus, fuel injection of the fuel injector 8 is carried out for the time period TAU.

Since the fuel injection time period TAU is calculated by the routine of FIG. 10, which uses the coefficients KLEAN and FAF obtained by the routines of FIGS. 3, 6, and 9, the larger the coefficient KLEAN, the richer the controlled air-fuel ratio, while the smaller the coefficient KLEAN, the leaner the controlled air-fuel ratio. Thus, the air-fuel ratio is controlled in accordance with the coefficient KLEAN. Therefore, according to the present invention, since a lower limit is applied to the coefficient KLEAN, a limit on the lean side is applied to the controlled air-fuel ratio.

Note that the present invention can be also applied to a fuel injection system using other parameters such as the intake air amount and the engine rotational speed, or the throttle opening value and the engine rotational speed.

As explained above, according to the present invention, since feedback control for a target air-fuel ratio on the lean side is carried out even during a warming-up mode, and in addition, the aimed air-fuel ratio is variable in accordance with the engine temperature, the air-fuel ratio during a warming-up mode can be controlled to be a value corresponding to the vaporization of fuel, and accordingly, the fuel consumption efficiency during an engine warming-up mode can be improved without affecting the drivability characteristics of the engine.

We claim:

1. A method for controlling the air-fuel ratio in an internal combustion engine comprising the steps of:

detecting the concentration of a specific composition in the exhaust gas;

calculating a target air-fuel ratio on the lean side with respect to the stoichiometric air-fuel ratio in accordance with predetermined parameters of said engine;

detecting the temperature of said engine;

adjusting the calculated target air-fuel ratio in accordance with the detected temperature of said engine, said adjusting step including the further steps of:

calculating an allowed limit value of the target air-fuel ratio on the lean side in accordance with the detected temperature of said engine, when the detected temperature of said engine is lower than a definite temperature;

determining whether or not the target air-fuel ratio is on the lean side with respect to the allowed limit value; and replacing the target air-fuel ratio with the allowed limit value only when the target air-fuel ratio is on the lean side with respect to the allowed limit value; and controlling the feedback of the air-fuel ratio of said engine in accordance with the detected concentration of the specific composition so that the air-fuel ratio of said engine is close to the adjusted target air-fuel ratio.

2. A method as set forth in claim 1, wherein said allowed limit value calculating step comprises a step of calculating an allowed limit value on the richer side when the detected temperature of said engine is lower.

3. A method as set forth in claim 1, wherein said allowed limit value calculating step comprises the steps of:

determining whether or not the detected temperature of said engine is lower than the definite temperature;

determining whether or not the detected temperature of said engine is higher than another definite temperature which is lower than the definite temperature;

making the allowed limit value a first definite value corresponding to the stoichimetric air-fuel ratio or a leaner air-fuel ratio with respect to the stoichimetric air-fuel ratio, when the detected temperature of said engine is lower than the another definite temperature; and making the allowed limit value a second definite value on the leaner side with respect to the first definite value, when the detected temperature of said engine is higher than or equal to said another temperature.

4. A method as set forth in claim 1, wherein said allowed limit value calculating step comprises the steps of:

determining whether or not the detected temperature of said engine is lower than the definite temperature;

determining whether or not the detected temperature of said engine is higher than another definite temperature which is lower than the definite temperature;

making the allowed limit value a first definite value corresponding to the stoichimetric air-fuel ratio or a leaner air-fuel ratio with respect to the stoichimetric air-fuel ratio, when the detected temperature of said engine is lower than the another definite temperature; and changing continuously the allowed limit value on the leaner side with respect to the first definite value, when the detected temperature of said engine is higher than or equal to said another temperature.

5. An apparatus for controlling the air-fuel ratio in an internal combustion engine comprising:

means for detecting the concentration of a specific composition in the exhaust gas;

means for calculating a target air-fuel ratio on the lean side with respect to the stoichimetric air-fuel ratio in accordance with predetermined parameter of said engine;

means for detecting the temperature of said engine;

means for adjusting the calculated target air-fuel ratio in accordance with the detected temperature of said engine, said adjusting means including:

means for calculating an allowed limit value of the target air-fuel ratio on the lean side in accordance with the detected temperature of said engine, when the detected temperature of said engine is lower than a definite temperature;

means for determining whether or not the target air-fuel ratio is on the lean side with respect to the allowed limit value; and means for replacing the target air-fuel ratio with the allowed limit value only when the target air-fuel ratio is on the lean side with respect to the allowed limit value; and means for controlling the feedback of the air-fuel ratio of said engine in accordance with the detected concentration of the specific composition so that the air-fuel ratio of said engine is close to the adjusted target air-fuel ratio.

6. An apparatus as set forth in claim 5, wherein said allowed limit value calculating means comprises means for calculating an allowed limit value on the richer side when the detected temperature of said engine is lower.

7. An apparatus as set forth in claim 5, wherein said allowed limit value calculating means comprises:

means for determining whether or not the detected temperature of said engine is lower than the definite temperature;

means for determining whether or not the detected temperature of said engine is higher than another definite temperature which is lower than the definite temperature;

means for making the allowed limit value a first definite value corresponding to the stoichimetric air-fuel ratio or a leaner air-fuel ratio with respect to the stoichimetric air-fuel a ratio, when the detected temperature of said engine is lower than the another definite temperature; and means for making the allowed limit value a second definite value on the leaner side with respect to the first definite value, when the detected temperature of said engine is higher than or equal to said another temperature.

8. An apparatus as set forth in claim 5, wherein said allowed limit value calculating means comprises:

means for determining whether or not the detected temperature of said engine is lower than the definite temperature;

means for determining whether or not the detected temperature of said engine is higher than another definite temperature which is lower than the definite temperature;

means for making the allowed limit value a first definite value corresponding to the stoichimetric air-fuel ratio or a leaner air-fuel ratio with respect to the stoichimetric air-fuel ratio, when the detected temperature of said engine is lower than the another definite temperature; and means for changing continuously the allowed limit value on the leaner side with respect to the first definite value, when the detected temperature of said engine is higher than or equal to another temperature.

* * * * *